US005336098A

United States Patent [19]

Zell et al.

[11] Patent Number: 5,336,098

[45] Date of Patent: Aug. 9, 1994

[54] DEVICE FOR THE ELECTRICAL CONNECTION OF SHIELDINGS OF MULTI-POLE PLUGS TO THE GROUNDED POTENTIAL LAYER OF A PRINTED CIRCUIT BOARD

[75] Inventors: Karl Zell, Niederpoecking; Peter Seidel, Groebenzell, both of Fed. Rep. of Germany

[73] Assignee: Siemens Aktiengesellschaft, Munich, Fed. Rep. of Germany

[21] Appl. No.: 78,106

[22] Filed: Jun. 18, 1993

[30] Foreign Application Priority Data

Jun. 29, 1992 [DE] Fed. Rep. of Germany ..... 9208700

[51] Int. Cl.[5] ..... H01R 13/648

[52] U.S. Cl. ..... 439/108; 439/607

[58] Field of Search ..... 439/45, 108, 607

[56] References Cited

U.S. PATENT DOCUMENTS 4,655,518 4/1987 Johnson et al. .
4,869,677 9/1989 Johnson et al. .
4,871,321 10/1989 Johnson .
4,909,743 3/1990 Johnson et al. .
5,080,597 1/1992 Seidel et al. ..... 439/95 X
5,259,773 11/1993 Champion et al. ..... 439/108

FOREIGN PATENT DOCUMENTS 3624883 1/1988 Fed. Rep. of Germany .
9208261 5/1992 World Int. Prop. O. ..... 439/607

*Primary Examiner*—Eugene F. Desmond
*Attorney, Agent, or Firm*—Hill, Steadman & Simpson

[57] ABSTRACT

The invention is directed to a device for the electrical connection of shieldings of multi-pole plugs comprising a spring strip housing to the grounded potential layer of a printed circuit board containing a plurality of contact blades residing perpendicularly thereon.

In order to achieve a shielding of the open end faces, the face sides of the plug, just like the longitudinal sides, are provided with a respective face shielding plate of the components side and of the solder side, whereby the face shielding plates are firmly joined to the shielding plates of the longitudinal sides and likewise comprise spring regions in the region of the contact blades.

16 Claims, 6 Drawing Sheets

DEVICE FOR THE ELECTRICAL CONNECTION OF SHIELDINGS OF MULTI-POLE PLUGS TO THE GROUNDED POTENTIAL LAYER OF A PRINTED CIRCUIT BOARD

BACKGROUND OF THE INVENTION

The invention is directed to a device for the electrical connection of shieldings of multi-pole plugs, to the grounded potential layer of a mother printed circuit board. The plugs comprising a spring strip housing connected to a module printed circuit board and a centering strip connected to the mother printed circuit board. The mother printed circuit board contains a plurality of contact blades residing perpendicularly thereon and whereby spring elements provided at the shieldings are arranged such that, in the plugged condition of the plugs, the spring elements resiliently press against contact blades conductively connected to the grounded potential layer of the mother printed circuit board.

The shieldings per plug are composed of an angled-off shielding plate arranged on the solder side and/or on the components side of the module printed circuit board. Shielding plate hooks can be engaged in admission funnels of outer spring chambers of the spring strip housing and are attached to the individual shielding plates at their lateral edges which point toward the mother printed circuit board. Press-in pins with which the shielding plates are connectable to a grounded potential layer present on the module printed circuit board are attached to the lateral edges of the angled-off part. The shielding plates in the region of the contact blades, comprise outwardly arced spring regions that rae separated from one another by slots and proceed parallel to the contact blades. The regions conduct the individual shielding plates to the contact blades. The length of the shielding plates corresponds to the single length or, respectively, a multiple length of an individual segment of the spring strip housing.

Such a device is disclosed, for example, by European Patent Application EP 89 114 840, corresponding to pending U.S. Ser. No. 07/864,211, filed Apr. 6, 1992, which is a continuation-in-part of U.S. Ser. No. 525,857, filed May 21, 1990. The described device in these applications has the disadvantage that the end faces of the plugs are not provided with any shielding.

SUMMARY OF THE INVENTION

It is an object of the present invention to provide shielding plates for a plug that not only provides longitudinal shielding, but enables a shielding of the otherwise open end faces.

This object is inventively achieved for a plug connecting a module printed circuit board to a mother printed circuit board, characterized in that respective face shielding plates of the solder side and/or components side that likewise comprise spring regions in the region of the contact blades are arranged at the end faces; in that the face shielding plates are bent off at their edges neighboring the longitudinal shielding plates and are connected to the longitudinal shielding plates by spot welds; in that the face shielding plates are connected to the grounded potential layer of the module printed circuit board via press-in pins at their edges adjacent the module printed circuit boards; and in that the edge regions of the face shielding plates in the region of the contact blades and neighboring the spring regions and partially overlapping are connected to one another by bending erect sheet metal tabs over.

As a consequence of the shaping of the shielding in the device of the invention, a shielding of the free end faces is achieved.

The invention shall be set forth in greater detail below with reference to an exemplary embodiment shown in the drawing.

DETAILED DESCRIPTION OF THE PREFERRED EMBODIMENTS

Figure 1:
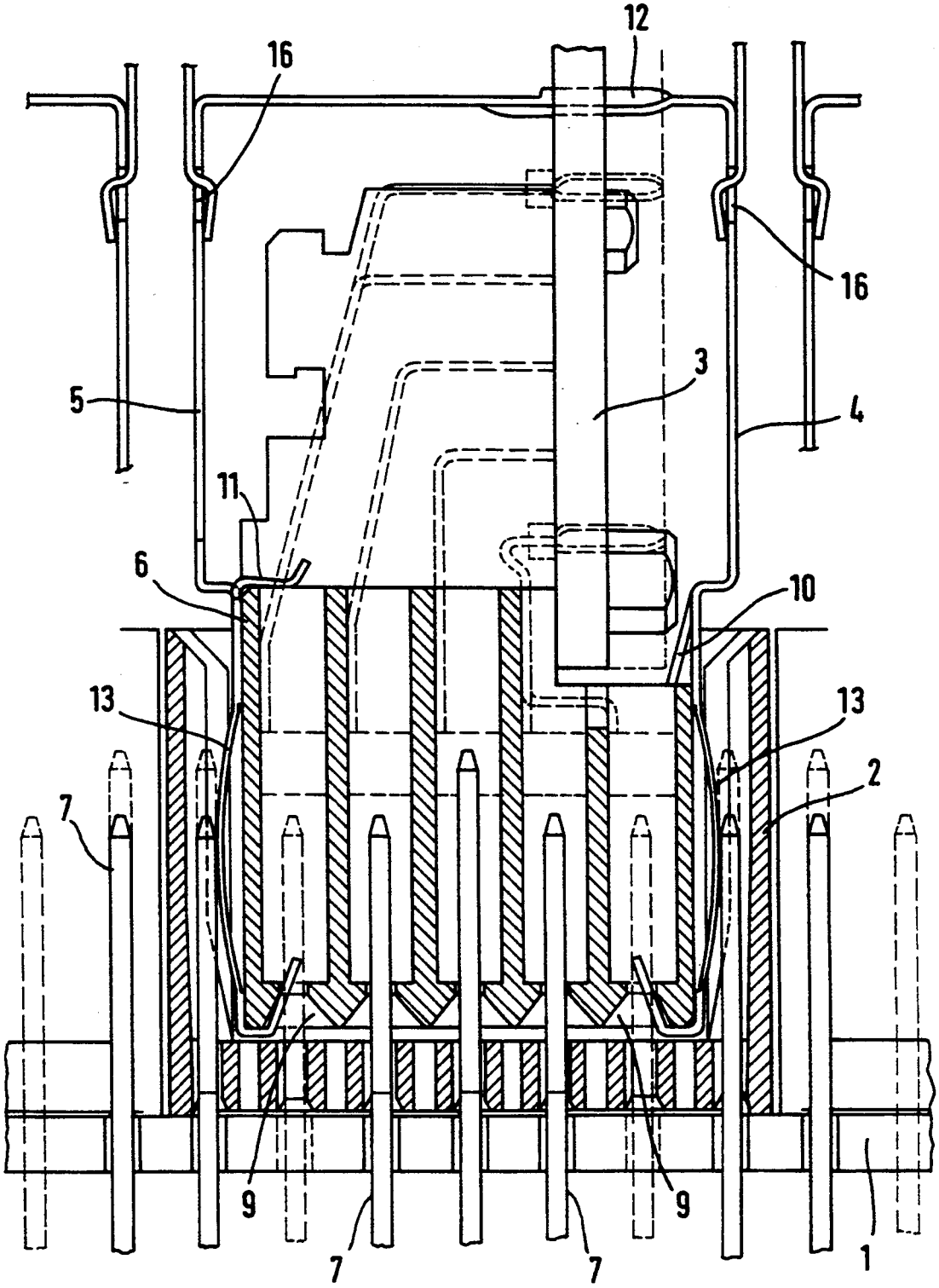
FIG. 1 is a section through a device for the electrical connection of the shieldings of multi-pole plugs to the grounded potential layer of a mother printed circuit board according to the present invention.
Figure 2:
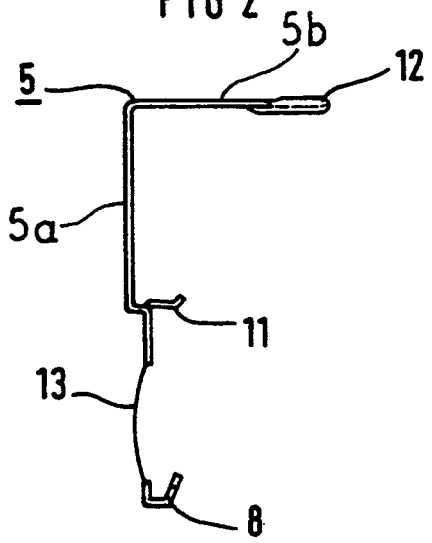
FIG. 2 is a side view of a longitudinal shielding plate at the components side.

FIG. 1 shows a section through a device for the electrical connection of the shieldings of multi-pole plugs to the grounded potential layer of a mother printed circuit board 1 according to the present invention. FIG. 1 shows the mother printed circuit board 1 having contact blades 7, whereby a centering strip 2 is arranged on the mother printed circuit board 1. A spring strip housing 6 that is connected to a module PC board 3 is inserted into this centering strip 2. In the illustrated exemplary embodiment, the shielding function for the spring strip housing 6 on the assembly is performed in part by longitudinal shielding plates 4 and 5. The shielding plate 4 is the shielding plate at the solder side and the shielding plate 5 is the shielding plate at the components side.

Dependent on the degree of shielding required, thus, the components side or the solder side or both sides together can be optionally provided with shielding plates.

Figure 3:
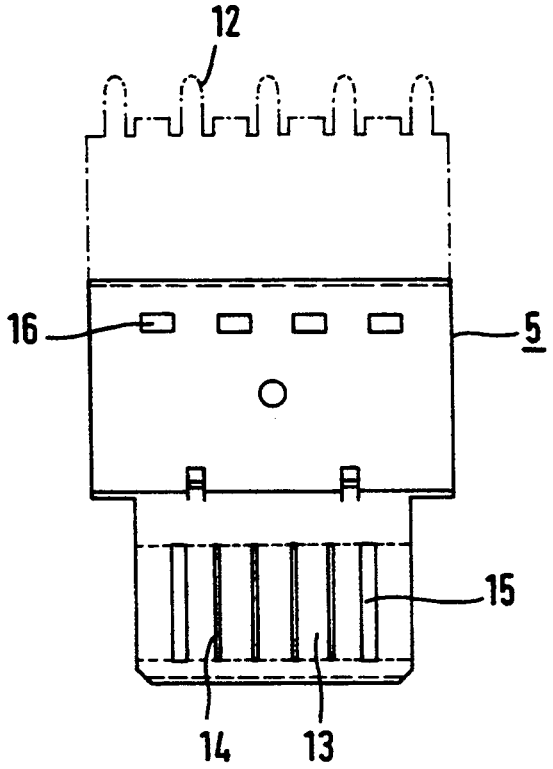
FIG. 3 is a plan view onto a longitudinal shielding plate of the components side shown in a plane.
Figure 4:
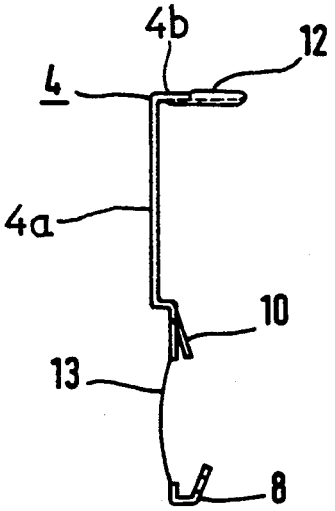
FIG. 4 is a side view of a longitudinal shielding plate of the solder side.
Figure 5:
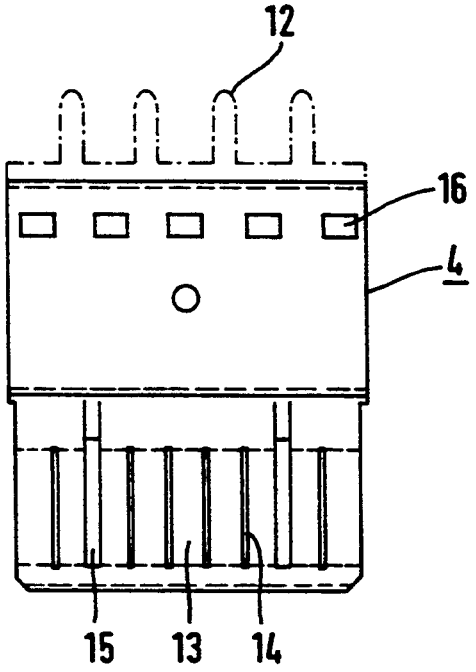
FIG. 5 is a plan view onto a longitudinal shielding plate of the components side shown in a plane.
Figure 6:
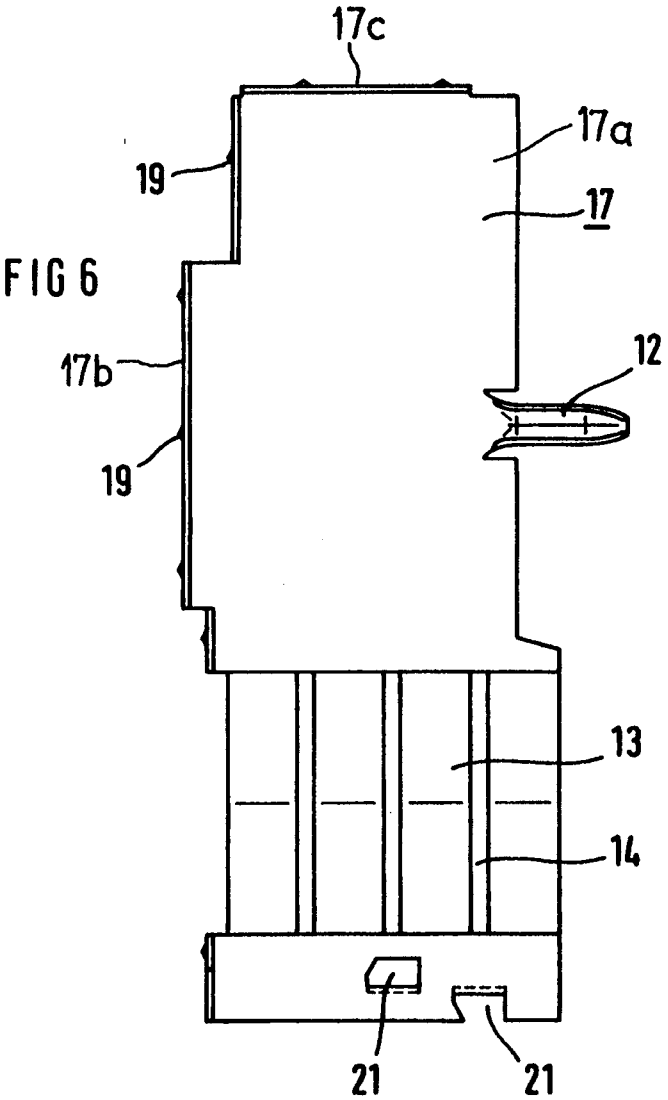
FIG. 6 is a plan view onto a face shielding plate of the components side.
Figure 7:
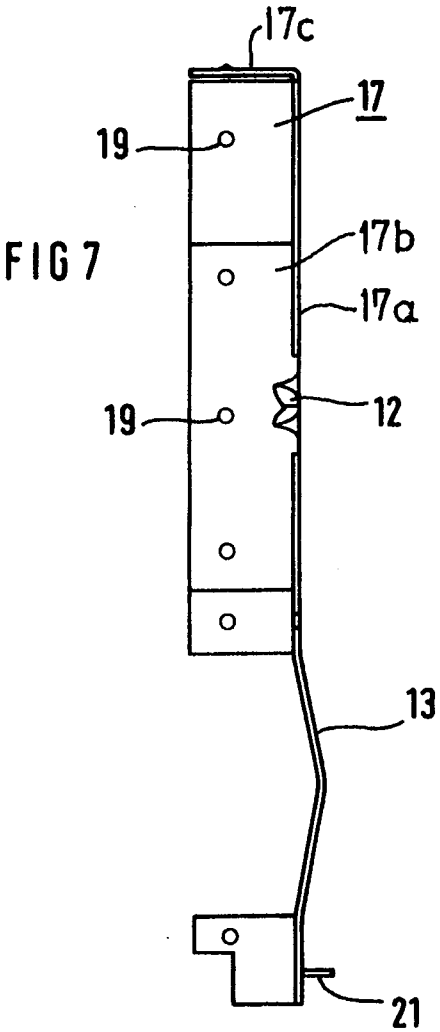
FIG. 7 is a side view of a face shielding plate of the components side.
Figure 9:
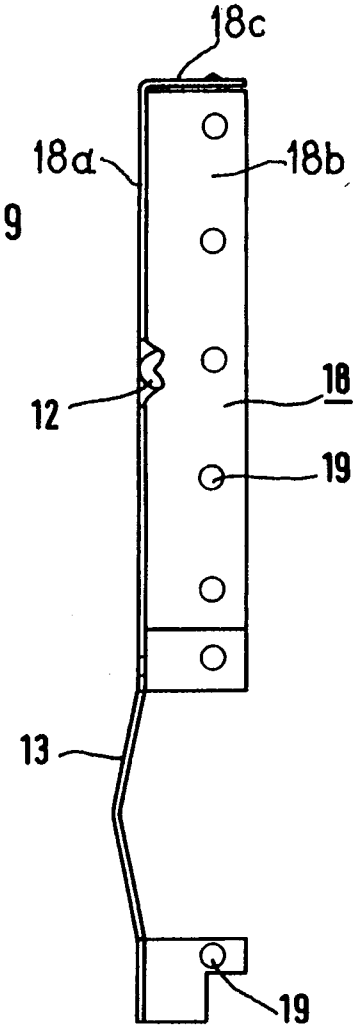
FIG. 9 is a side view of a face shielding plate of the solder side.
Figure 8:
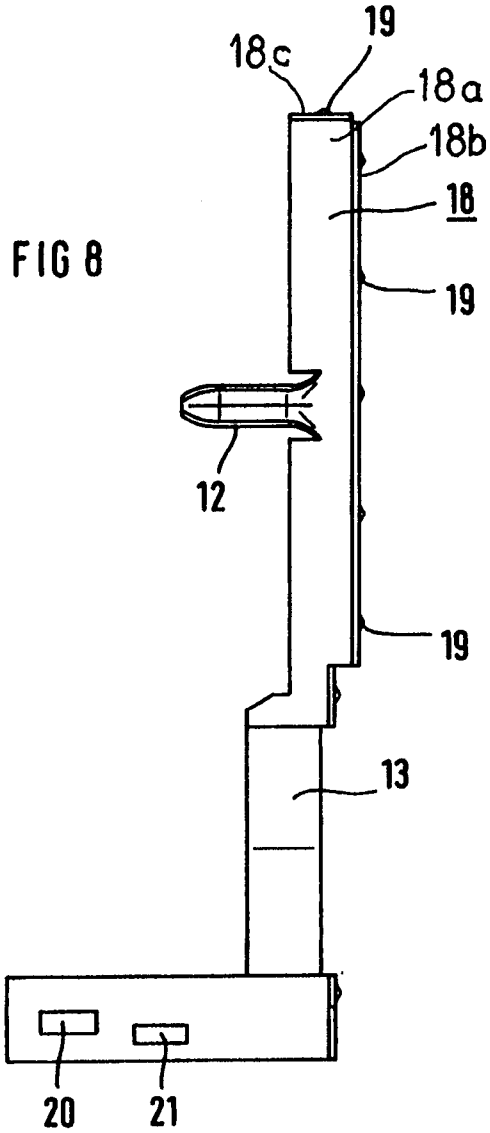
FIG. 8 is a plan view onto a face shielding plate of the solder side.
Figure 10:
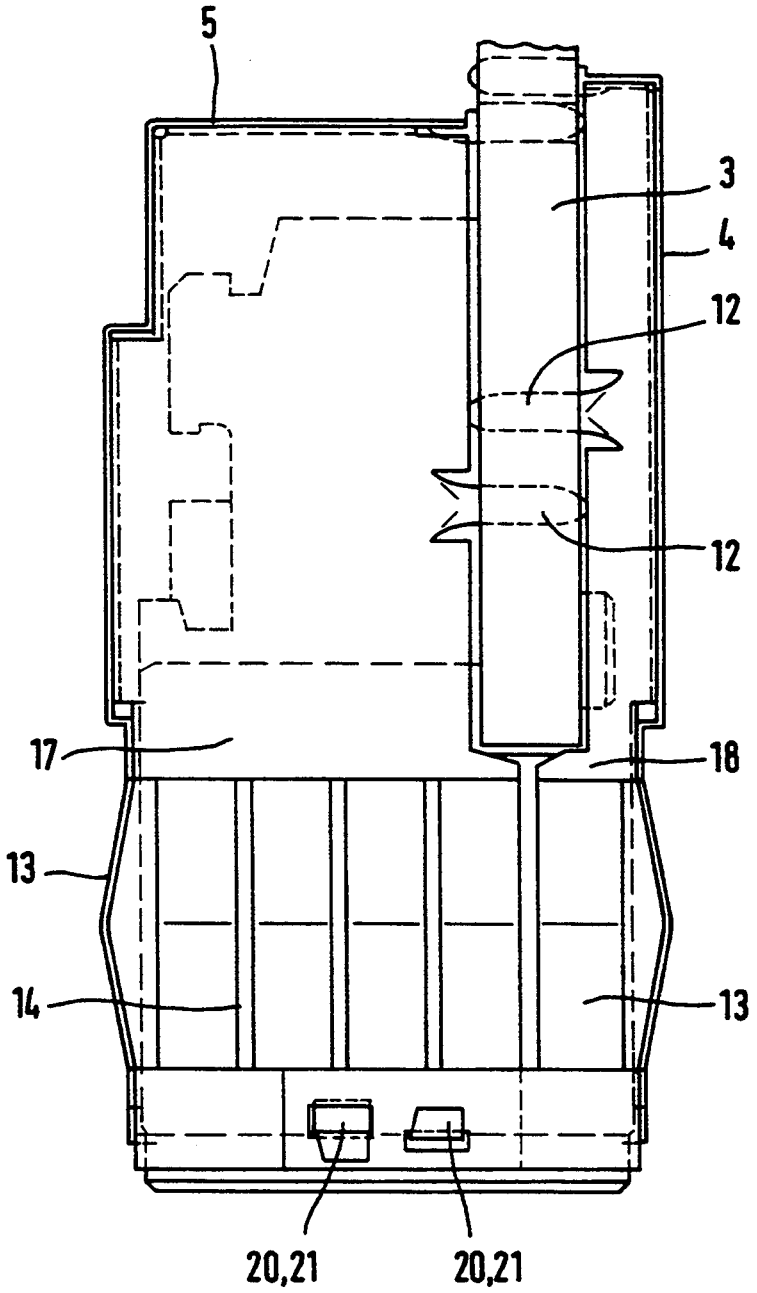
FIG. 10 is a plan view onto an end face of a plug shielded in conformity with the invention.

More detailed illustrations of the shielding plates 4 and 5 are contained in FIGS. 2 through 5. FIGS. 3 and 5 thereby show shielding plates having the length of a module of the spring strip or, respectively, of the spring strip housing 6. The length of the shielding plate, however, can be a whole-line multiple (not shown here) of this basic length up to the overall length of the spring strip housing 6.

The longitudinal shielding plates 4 and 5 comprise first regions 4*a*, 5*a* generally parallel to the module printed circuit board 3 and bent-off regions 4*b*, 5*b* directed toward the module printed circuit board 3.

The fastening of the shielding plates 4 and 5 ensues multiply. First, the individual shielding plates 4 and 5 are provided with shielding plate hooks at their side edges pointing in the direction of the mother printed circuit board 1. These shielding plate hooks 8 engage in admission funnels 9 of outer spring chambers of the spring strip housing 6. Press-in pins 12 with which the shielding plates 4 and 5 are connected to the module PC board 3 are attached to the lateral edges of the angled-off part of the shielding plates, the bent-off regions 4*b*, 5*b*. The electrical connection of the shielding plates to the module PC board 3 thereby ensues with a proven press-in technique, whereby the press-in pins comprise an elastic press-in region. The press-in pins of the two shielding plates thereby engage in one another comb-like inside plated through holes of the module PC board 3.

At the same time, the shielding plates 4 and 5 are held at that side of the spring strip housing 6 facing toward the module PC board 3 with catch means such as catch tongues 10 at the shielding plate 4 of the solder side as well as catch hooks 11 at the shielding plate 5 of the components side. Protection against an unintentional detachment of the shielding plates 4 and 5 during a plugging or, respectively, pulling process is thus guaranteed.

The contacting of the shielding plates 4 and 5 to the contact blades 7 ensues via the spring regions 13 separated by slots 14. These spring regions 13 are produced in that this region is milled thinner during the manufacturing process and is pre-bent in a further work step. The arced spring regions 13 of the shielding plates 4 and 5 separated by the slots 14 enable electrical connections to the contact blades 7 that are independent of one another, the contact blades 7 being in turn connected via plated-through holes to the ground potential of the mother printed circuit board 1.

Individual, broadened slots 15 between the spring regions enable a pre-centering or, respectively, guidance of the shielded spring strip 6 within a centering strip 2.

Additional clearances 16 at the shielding plates 4 and 5 allow further shielding plates to be hooked in or, respectively, connected, the complete assembly or parts thereof being capable of being shielded with these.

FIGS. 6 through 10 show the employment of the face shielding plates of the components side 17 and of the solder side 18. The face shielding plates 17 and 18, like the longitudinal shielding plates 4 and 5, comprise identically shaped, arced spring regions 13 with intervening slots 14 for which the aforementioned is also valid. Both the face shielding plates of the solder side as well as the face shielding plates 17 and 18 of the components side, like the longitudinal shielding plates 4 and 5, are connected with press-in pins 12 to the grounded potential layer of the module printed circuit board 3. Both the face shielding plate 17 of the components side as well as the face shielding plate 18 of the solder side are connected to the longitudinal shielding plates 4 and 5 via spot weld connections 19 at bent-off edges. The shielding plates thus have face sides 17*a*, 18*a*, bent-off sides 17*b*, 18*b*, and third regions 17*c*, 18*c* which conform approximately to three perpendicular planes.

The edge regions of the face shielding plates 17 of the components side and of the face shielding plates 18 of the solder side that are adjacent to the spring regions 13 and partially overlap in the region of the contact blades 7 are connected to one another by bending over erect sheet metal tabs 21 that have been plugged through clearances 20 of the respectively overlapping face shielding plate.

The face shielding plates 17, 18 can be repeated at an opposite longitudinal end of the spring strip housing 6 and along with the longitudinal shielding, create an all around shielding of a region of or all of the spring strip housing 1.

A transmission of high bit rates having a frequency $\leqq 1$ GHz to be anticipated in future becomes unproblematical in this way given the shielding of the inventive device.

In conclusion, it should also be pointed out that the shielding of the invention and the spring strip housings are fashioned such that a retrofitting with shielding plates can be readily accomplished.

Although the present invention has been described with reference to a specific embodiment, those of skill in the art will recognize that changes may be made thereto without departing from the scope and spirit of the invention as set forth in the appended claims.

I claim as my invention:

1. A device for the connection of shieldings of multipole plugs having a spring strip housing, the plugs associated with a module printed circuit board, to the grounded potential layer of a mother printed circuit board containing a plurality of contact blades residing perpendicularly thereon, comprising:

two longitudinal shields arranged on opposite sides of the module circuit board and having spring elements arranged such that, in the plugged condition of the plug, the spring elements resiliently press against allocated contact blades conductively connected to the grounded potential layer of the mother printed circuit board;

the longitudinal shields each having an angled-off shielding plate shielding a portion of the respective side of the module printed circuit board;

shielding plate hooks that can be engaged to the spring strip housing and are attached to the individual longitudinal shielding plates at lateral edges pointing in the direction of the mother printed circuit board;

press-in pins connected to a lateral edge of the angled-off shielding plates with which the shielding plates are connectable to a grounded potential layer present on the module printed circuit board;

two respective face shielding plates each oriented having an end face plate substantially perpendicular to the module printed circuit board for shielding an end face of the shielded spring strip housing, and having a spring region in the region of the contact blades:

the face shielding plates are bent off from said end face plate adjacent the longitudinal shielding plates and are connected to the longitudinal shielding plates by spot welds;

the face shielding plates are connected to the grounded potential layer of the module printed circuit board via press-in pins at the edges of said end face plates adjacent the module printed circuit board; and the edge regions of the end face plate of the face shielding plates located in the region of the contact blades and neighboring the spring regions are partially overlapping and are connected to one another by bending over erect sheet metal tabs.

2. A device for shielding a region of a multi-pole plug connected to a plurality of contacts on a mother printed circuit board, the mother printed circuit board providing ground contact blades electrically connected to the grounded potential layer of the mother printed circuit board, the plug connected to a module printed circuit board arranged perpendicular to the mother printed circuit board, the multi-pole plug electrically connected to positions on said module printed circuit board, comprising:

a first longitudinal shielding plate arranged on a solder side of the module printed circuit board, and a second longitudinal shielding plate arranged on a component side of the modular printed circuit board, the first and second longitudinal shielding plates having first regions parallel to a facing surface of said module circuit board that resiliently engage with said ground contact blades and bent off regions arranged longitudinally and bent toward said module printed circuit board with press-in pins which connect to a ground potential layer of said module printed circuit board; and a first face shield plate and a second face shield plate, said first face shield plate arranged on the solder side of the module printed circuit board and said second face shield plate arranged on the component side of the module printed circuit board, said first and second face shield plates arranged at an end of a shielded region of said plug and fastened to respective adjacent first and second longitudinal shielding plates, said first and second face shield plates having face sides extending toward said module printed circuit board transversely, and longitudinally bent-off sides parallel to the plane of said first regions, said face sides angled from said bent-off sides, said first and second face shield plates having press-in pins for connecting to the ground layer of said module printed circuit board.

3. The device according to claim 2, wherein said face sides of said first and second face shield plates are partially overlapped and connected together.

4. The device according to claim 3, wherein said face sides are connected together by a bent sheet metal tab and slot connection.

5. The device according to claim 2, wherein said face sides of said first and second face shield plates comprise outwardly arced spring regions that are separated from one another by slots for making electrical contact with contact blades.

6. The device of claim 2, wherein said first and second face shield plates are connected to said first and second longitudinal shielding plates respectively by spot welding said longitudinally arranged sides to said first regions.

7. The device of claim 2, wherein said first and second face shield plates comprise third regions which are parallel to and overlap said bent-off regions and are connected thereto.

8. A device for shielding a region of a multi-pole plug connected to a plurality of contacts on a first printed circuit board, the first printed circuit board providing ground contact blades electrically connected to the grounded potential layer of the first printed circuit board, the plug connected to a second printed circuit board arranged perpendicular to the first printed circuit board, the multi-pole plug electrically connected to positions on said second printed circuit board, comprising:

a first longitudinal shielding plate arranged on a solder side of the second printed circuit board, and a second longitudinal shielding plate arranged on a component side of the second printed circuit board, the first and second longitudinal shielding plates having first regions generally planarly parallel to a surface of said second printed circuit board, said first regions resiliently engage with said ground contact blades and have bent off regions longitudinally arranged and extending toward said second printed circuit board and which connect to a ground potential layer of said second printed circuit board; and a first face shield plate and a second face shield plate, said first face shield plate arranged on the solder side of the second printed circuit board and said second face shield plate arranged on the component side of the second printed circuit board, said first and second face shield plates arranged at an end of a shielded region of said plug and connected to respective adjacent first and second longitudinal shielding plates, said first and second face shield plates having face sides extending transversely toward said second printed circuit board, and longitudinal bent-off sides parallel to said first regions and said face sides angled from the plane of said first regions, said face sides approaching said second printed circuit board closely to define an end to the shielded region of said plug.

9. The device according to claim 8, wherein said first face shield plate and said second face shield plates are partially overlapped at said face sides and are connected together.

10. The device according to claim 8, wherein said face sides comprise outwardly arced spring regions that are separated from one another by slots.

11. The device according to claim 8, wherein said first and second face shield plates have press-in pins for connecting to the ground layer of said second printed circuit board.

12. The device according to claim 11, wherein said first and second face shield plate are spot welded to said first and second longitudinal shielding plates respectively.

13. The device according to claim 11, wherein said first face shield plate and said second face shield plates are partially overlapped at an end region of said face sides and are connected together.

14. The device according to claim 11, wherein said first and second face shield plates comprise outwardly arced spring regions that are separated from one another by slots, said arced spring regions resiliently contacting allocated ground contact blades of said first printed circuit board.

15. The device according to claim 8, wherein said first and second face shield plate comprise a third region angled from said bent-off sides and said face sides, the third region parallel and overlapping said bent-off region of a respective adjacent one of said first and second longitudinal shielding plates, and connected thereto.

16. The device according to claim 15, wherein said third regions are connected to said bent-off regions, and said bent-off sides are connected to said first regions by spot welding.

* * * * *